US007667661B2

(12) United States Patent
Chou et al.

(10) Patent No.: US 7,667,661 B2
(45) Date of Patent: Feb. 23, 2010

(54) ELECTRONIC DEVICE AND SHORT-CIRCUITED DIPOLE ANTENNA THEREOF

(75) Inventors: Jui-Hung Chou, Taichung (TW); Saou-Wen Su, Taipei (TW)

(73) Assignee: Lite-On Technology Corporation, Taipei (TW)

( * ) Notice: Subject to any disclaimer, the term of this patent is extended or adjusted under 35 U.S.C. 154(b) by 4 days.

(21) Appl. No.: 12/076,298

(22) Filed: Mar. 17, 2008

(65) Prior Publication Data

US 2009/0015501 A1 Jan. 15, 2009

(30) Foreign Application Priority Data

Jul. 10, 2007 (TW) ..... 96125142 A

(51) Int. Cl.
*H01Q 9/28* (2006.01)

(52) U.S. Cl. ..... 343/795; 343/809

(58) Field of Classification Search ..... 343/795, 343/793, 803, 809
See application file for complete search history.

(56) References Cited

U.S. PATENT DOCUMENTS 6,621,464 B1 9/2003 Fang et al.
6,937,204 B2 8/2005 Hall
6,961,028 B2 * 11/2005 Joy et al. ..... 343/895

* cited by examiner

*Primary Examiner*—Hoang V Nguyen
(74) *Attorney, Agent, or Firm*—Bacon & Thomas, PLLC

(57) ABSTRACT

An electronic device and short-circuited dipole antenna thereof are provided. The short-circuited dipole antenna comprises a first radiation unit, a second radiation unit and a short-circuited unit. The short-circuited unit comprises a first terminal connected to the first radiation unit, and a second terminal connected to the second radiation unit.

17 Claims, 7 Drawing Sheets

ELECTRONIC DEVICE AND SHORT-CIRCUITED DIPOLE ANTENNA THEREOF

This application claims the benefit of Taiwan application Serial No. 96125142, filed Jul. 10, 2007, the subject matter of which is incorporated herein by reference.

BACKGROUND OF THE INVENTION

1. Field of the Invention

The invention relates in general to an electronic device and dipole antenna thereof, and more particularly to an electronic device having a short-circuited unit and short-circuited dipole antenna thereof.

2. Description of the Related Art

With the widespread development of wireless technology, more and more electronic devices become wireless and have different kinds of wireless communications functions. For example, after a wireless printer is connected to an external antenna device, the user can print the required documents, no matter when or where the user is, without the need to upload the documents to a computer connected with a printer. As a result, the user can have higher convenience in operation.

However, the external antenna device will deteriorate the appearance of the wireless printer. Therefore, how to maintain the appearance of the whole device and, at the same time, to keep a good transmission effect for the antenna are essential issues to be resolved at present.

SUMMARY OF THE INVENTION

The invention is directed to an electronic device and short-circuited dipole antenna thereof. By short-circuiting the first radiation unit and second radiation unit of the dipole antenna, the short-circuited dipole antenna has at least the advantages of having a simple structure, easy manufacture process, low production cost, small size and preventing to deteriorate the appearance of the electronic device as disposed in a corner of the electronic device.

According to the present invention, a short-circuited dipole antenna is provided. The short-circuited dipole antenna comprises a first radiation unit, a second radiation unit and a short-circuited unit. The short-circuited unit comprises a first terminal connected to the first radiation unit, and a second terminal connected to the second radiation unit. The circuit board is for receiving and transmitting wireless signals through the short-circuited dipole antenna.

The invention will become apparent from the following detailed description of the preferred but non-limiting embodiments. The following description is made with reference to the accompanying drawings.

DETAILED DESCRIPTION OF THE INVENTION

Figure 1:
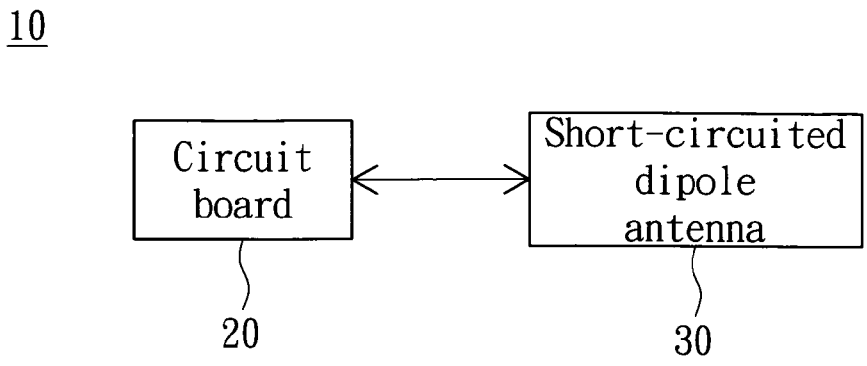
FIG. 1 is a block diagram of an electronic device.

Referring to FIG. 1, a block diagram of an electronic device is shown. An electronic device 10 includes a circuit board 20 and a short-circuited dipole antenna 30. The circuit board 20 is receiving and transmitting wireless signals through the short-circuited dipole antenna 30. The electronic device 10 is a wireless local area network (WLAN) device, such as a wireless printer or a notebook computer.

The short-circuited dipole antenna 30 includes a first radiation unit, a second radiation unit and a short-circuited unit. The structures of the first radiation unit, second radiation unit and short-circuited unit are respectively illustrated in the following first to fourth embodiments.

The first radiation unit and second radiation unit of the short-circuited dipole antenna 30 generate a resonant frequency (half-wavelength) to cover the required bandwidth of the WLAN (2400-2484 MHz). The short-circuited unit includes a first terminal and a second terminal for respectively connecting to the first radiation unit and second radiation unit.

Owing to that the short-circuited unit is connected between the first radiation unit and second radiation unit, the short-circuited antenna of the embodiment at least has the following advantages:

1. The structure of the short-circuited dipole antenna is simpler than the prior art;
2. The manufacturing of the short-circuited dipole antenna is easier than the prior art;
3. The manufacture cost of the short-circuited dipole antenna is lower than the prior art;
4. The size of the radiation unit is smaller; and
5. The short-circuited dipole antenna can be disposed in a corner of the electronic device to prevent deteriorating the appearance of the electronic device.

In order to describe the content of the invention in more details, the following first to fourth embodiments are given for illustration, but the invention is not thereto. One who has ordinary skills in related art of the invention will realize that the scope of the appended claims therefore should be accorded the broadest interpretation so as to encompass all such modifications and similar arrangements and procedures.

Embodiment One

Figure 2:
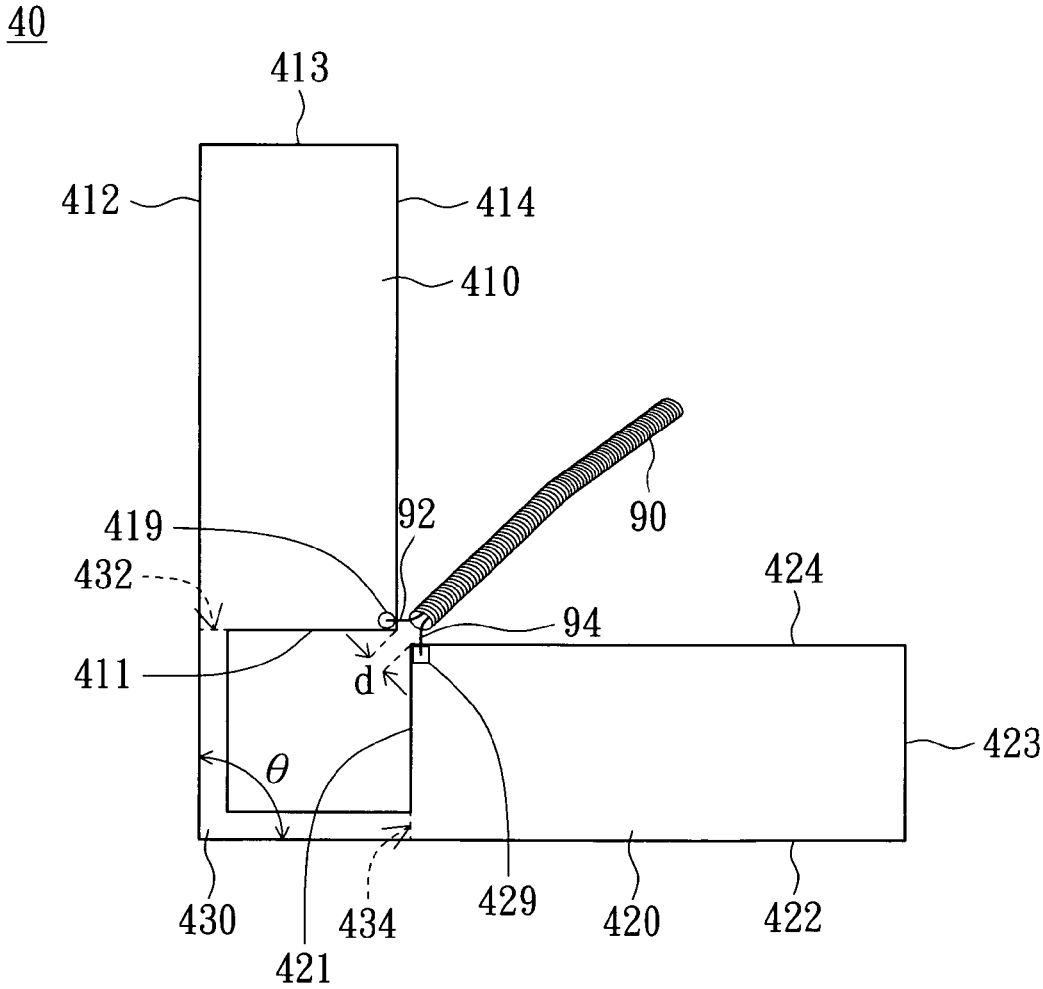
FIG. 2 is a schematic diagram of a short-circuited dipole antenna according to a first embodiment of the invention.

Referring to FIG. 2, a schematic diagram of a short-circuited dipole antenna according to a first embodiment of the invention is shown. The short-circuited dipole antenna 30 is the short-circuited dipole antenna 40 of FIG. 2 for instance, and the short-circuited dipole antenna 40 includes radiation units 410 and 420 and a short-circuited unit 430. For example, the radiation units 410 and 420 and the short-circuited unit 430 are manufactured into a unity and formed on a dielectric substrate by printing or etching. Besides, the radiation units 410 and 420 and the short-circuited unit 430 can also be formed by cutting metal sheets.

The short-circuited dipole antenna 40 not only has a simple structure but also has a low production cost when the radiation units 410 and 420 and the short-circuited unit 430 are manufactured into a unity. Besides, owing to that the radiation units 410 and 420 and the short-circuited unit 430 are manufactured into a unity, no extra plastic supporter is needed for fixing the radiation units 410 and 420, and thus the manufacture for the short-circuited dipole antenna 40 is easier than the prior art. Furthermore, the short-circuited dipole antenna 40 can be disposed in a corner of the electronic device 20, and thus the appearance of the electronic device 20 remains aesthetically pleasing.

For example, the minimum distance d between the radiation units 410 and 420 is between 0 and 2 mm, and the radiation units 410 and 420 respectively have feed points 419 and 429 for respectively connecting to a central conductor 92 and an external grounding conductor 94 of a coaxial transmission line 90.

In more details, the radiation unit 410 includes sides 411, 412, 413 and 414. The sides 411 and 412 of the radiation unit 410 are substantially in parallel to the sides 413 and 414 respectively and the sides 411 and 413 are vertical to the sides 412 and 414 respectively to form a rectangle.

Similarly, the radiation unit 420 includes sides 421, 422, 423 and 424. The sides 421 and 422 of the radiation unit 420 are substantially in parallel to the sides 423 and 424 respectively and the sides 421 and 423 are vertical to the sides 422 and 424 respectively to form another rectangle.

The length of the sides 411, 413, 421 and 423 are substantially equal, and the length of the sides 412, 414, 422 and 424 are substantially equal. The sides 412, 414, 422 and 424 are respectively longer than the sides 411, 413, 421 and 423. Besides, the extension directions of the sides 412 and 422 form an angle θ, such as between 90 degrees and 180 degrees.

The short-circuited unit 430, such as of a strip structure, has a first terminal 432 and a second terminal 434. The first terminal 432 is connected to the side 411 while the second terminal 434 is connected to the side 421. Owing to that the short-circuited unit 430 is connected between the radiation units 410 and 420, the central frequency of the short-circuited dipole antenna 40 can be decreased to reduce the size of the radiation units 410 and 420.

For example, the length of the sides 411, 413, 421 and 423 is 6 mm, the length of the sides 412, 414, 422 and 424 is 23.5 mm, and the width of the short-circuited unit 430 is 1 mm. However, the antenna of the invention is not limited to the above structure.

Figure 3:
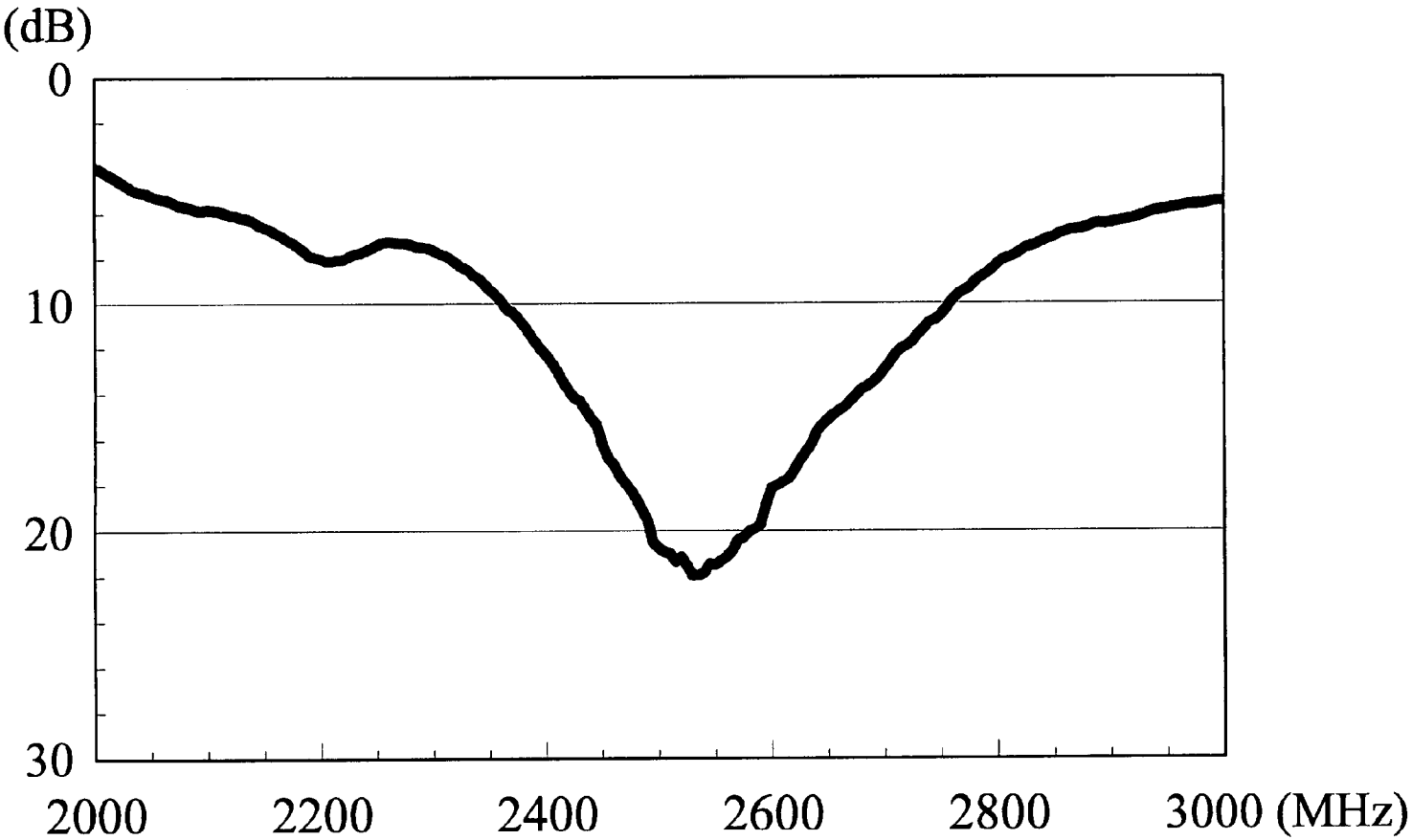
FIG. 3 is the measured return loss.
Figure 4:
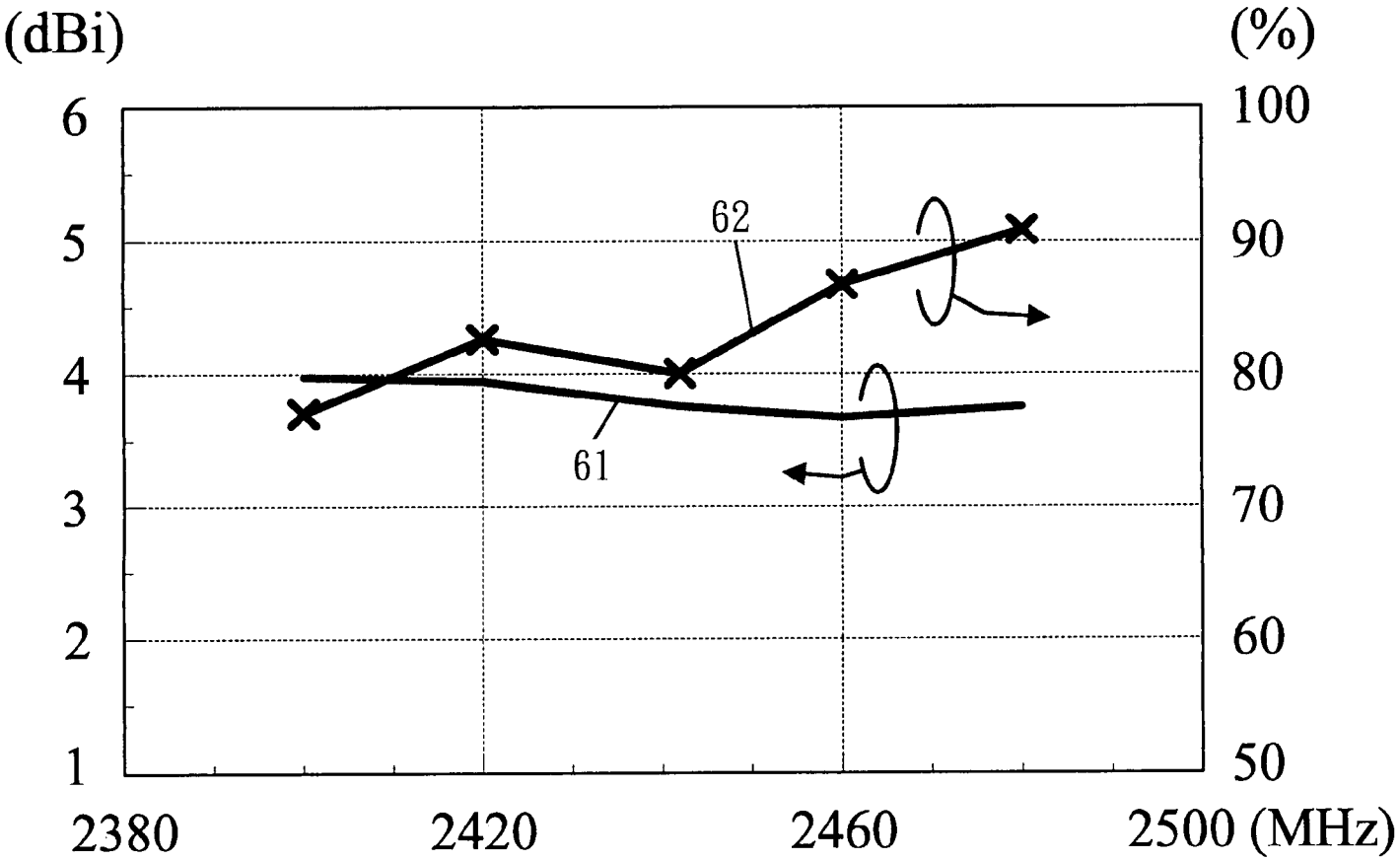
FIG. 4 is the measured antenna gain and radiation efficiency.

Referring to FIG. 3 and FIG. 4, a diagram of the measured return loss and a diagram of the measured antenna gain and radiation efficiency are shown respectively. The curve 61 of FIG. 4 represents the antenna gain of the short-circuited dipole antenna 40 from 2380 MHz to 2500 MHz. The curve 62 of FIG. 4 represents the radiation efficiency of the short-circuited dipole antenna 40 from 2380 MHz to 2500 MHz. From the measurement results in FIG. 3 and FIG. 4, it can be known that the return loss, antenna gain and radiation efficiency of the short-circuited dipole antenna 40 can meet the expected target values.

Figure 5:
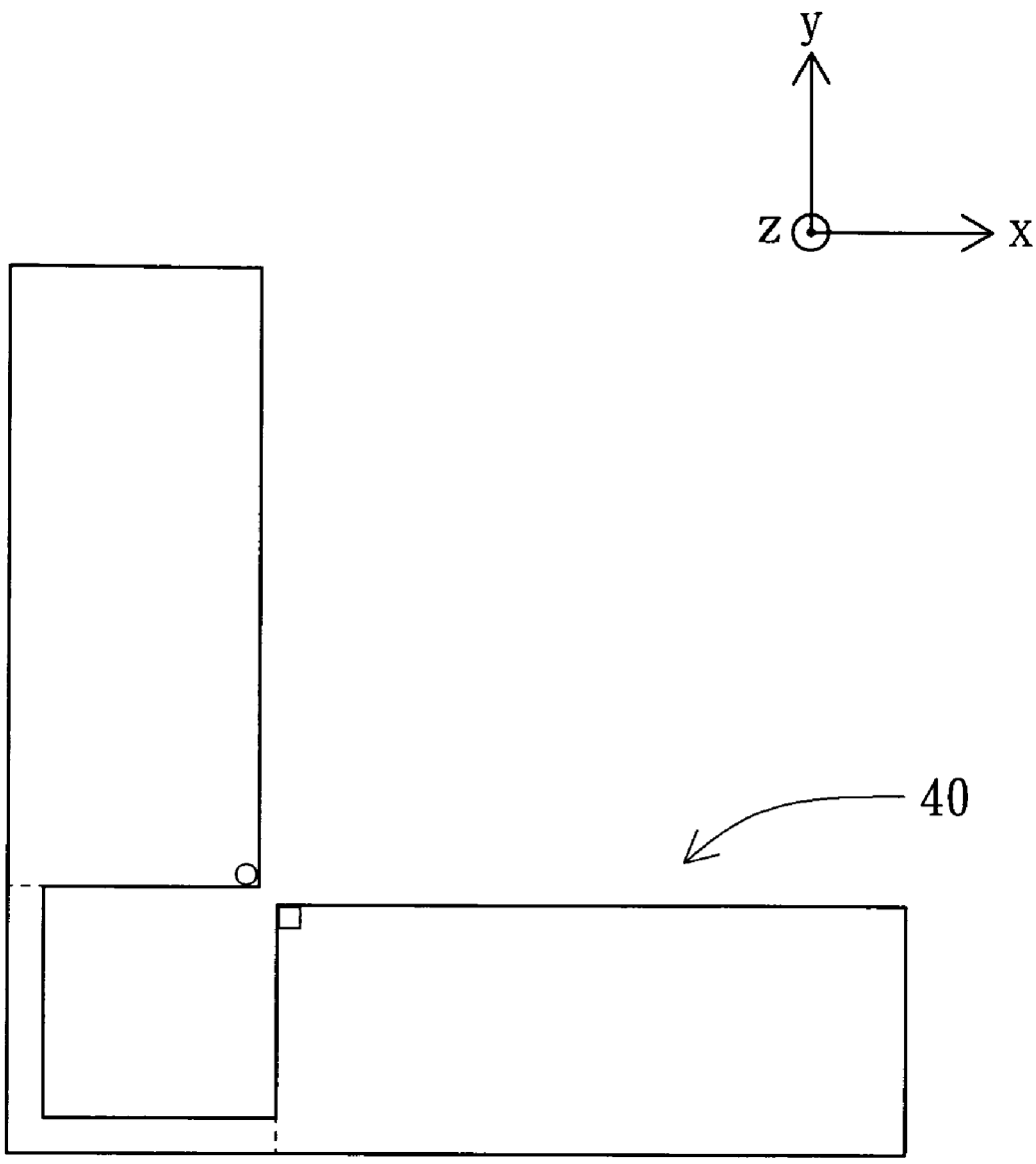
FIG. 5 is a schematic diagram of the short-circuited dipole antenna disposed on the plane x-y.

Referring to FIG. 5, a schematic diagram of the short-circuited dipole antenna 40 disposed on the plane x-y is shown. According to the experiment result, when the short-circuited dipole antenna 40 is disposed on the plane x-y and has respectively the operating frequencies at 2400 MHz, 2442 MHz and 2484 MHz, the radiation patterns of the short-circuited dipole antenna 40 can still meet the expected target values although the radiation units 410 and 420 have smaller area than that of the prior art.

Embodiment Two

Figure 6:
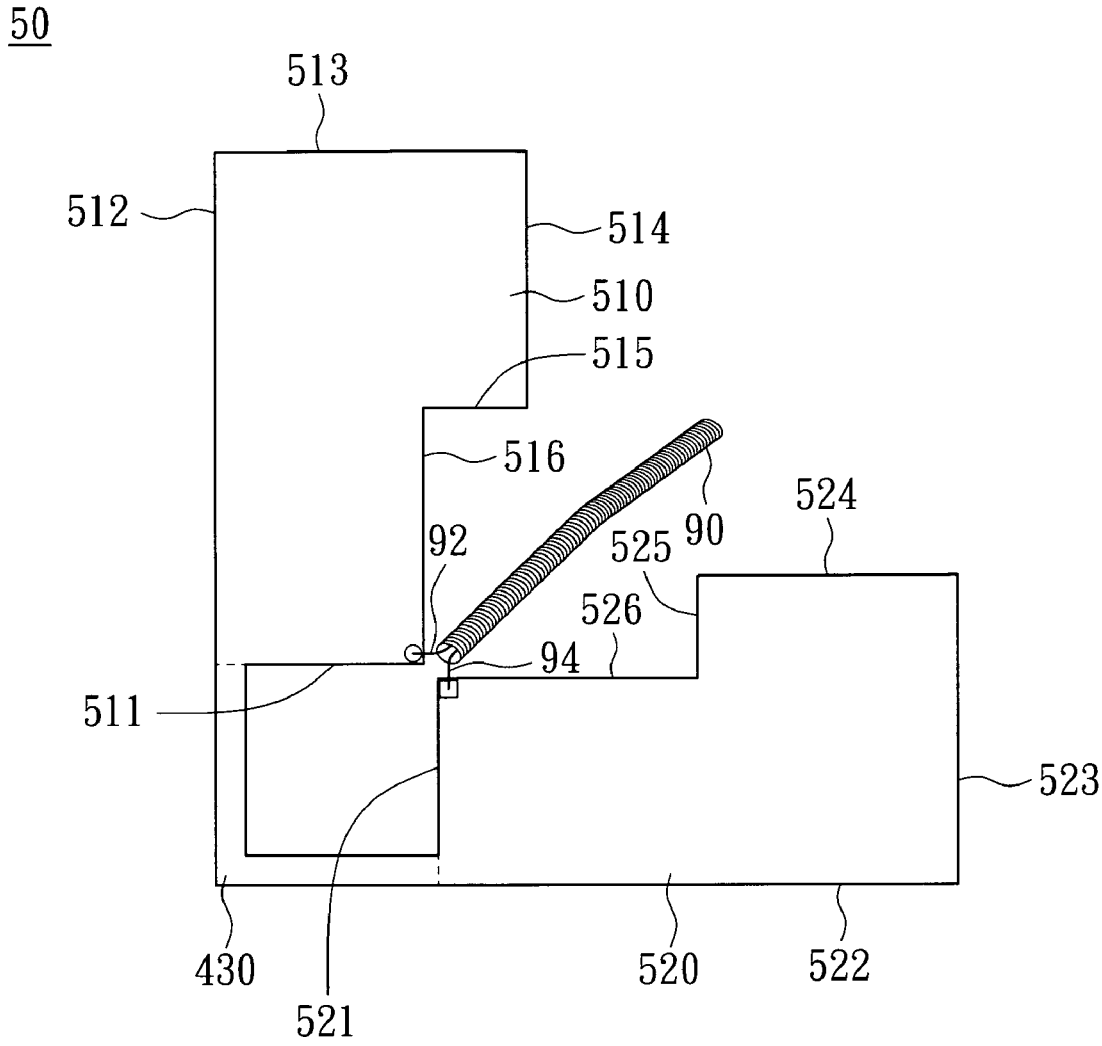
FIG. 6 is a schematic diagram of a short-circuited dipole antenna according to a second embodiment of the invention.

Referring to FIG. 6, a schematic diagram of a short-circuited dipole antenna according to a second embodiment of the invention is shown. The difference between the first embodiment and the second embodiment lies on that the radiation units 510 and 520 of the second embodiment have different shapes from the radiation units 410 and 420 of the first embodiment.

The radiation unit 510 includes sides 511, 512, 513, 514, 515 and 516. For example, the side 513 is longer than the side 511, and the side 511 is longer than the side 515. The sides 511 and 513 of the radiation unit 510 are substantially in parallel to the side 515, while the sides 512 and 514 of the radiation 510 are substantially in parallel to the side 516. The sides 511, 513 and 515 are substantially vertical to the sides 512, 514 and 516 respectively to form an L shape.

Similarly, the radiation unit 520 includes sides 521, 522, 523, 524, 525 and 526. For example, the side 523 is longer than the side 521, and the side 521 is longer than the side 525. The sides 521 and 523 of the radiation unit 520 are substantially in parallel to the side 525, while the sides 522 and 524 of the radiation 520 are substantially in parallel to the side 526. The sides 521, 523 and 525 are substantially vertical to the sides 522, 524 and 526 respectively to form another L shape.

Embodiment Three

Figure 7:
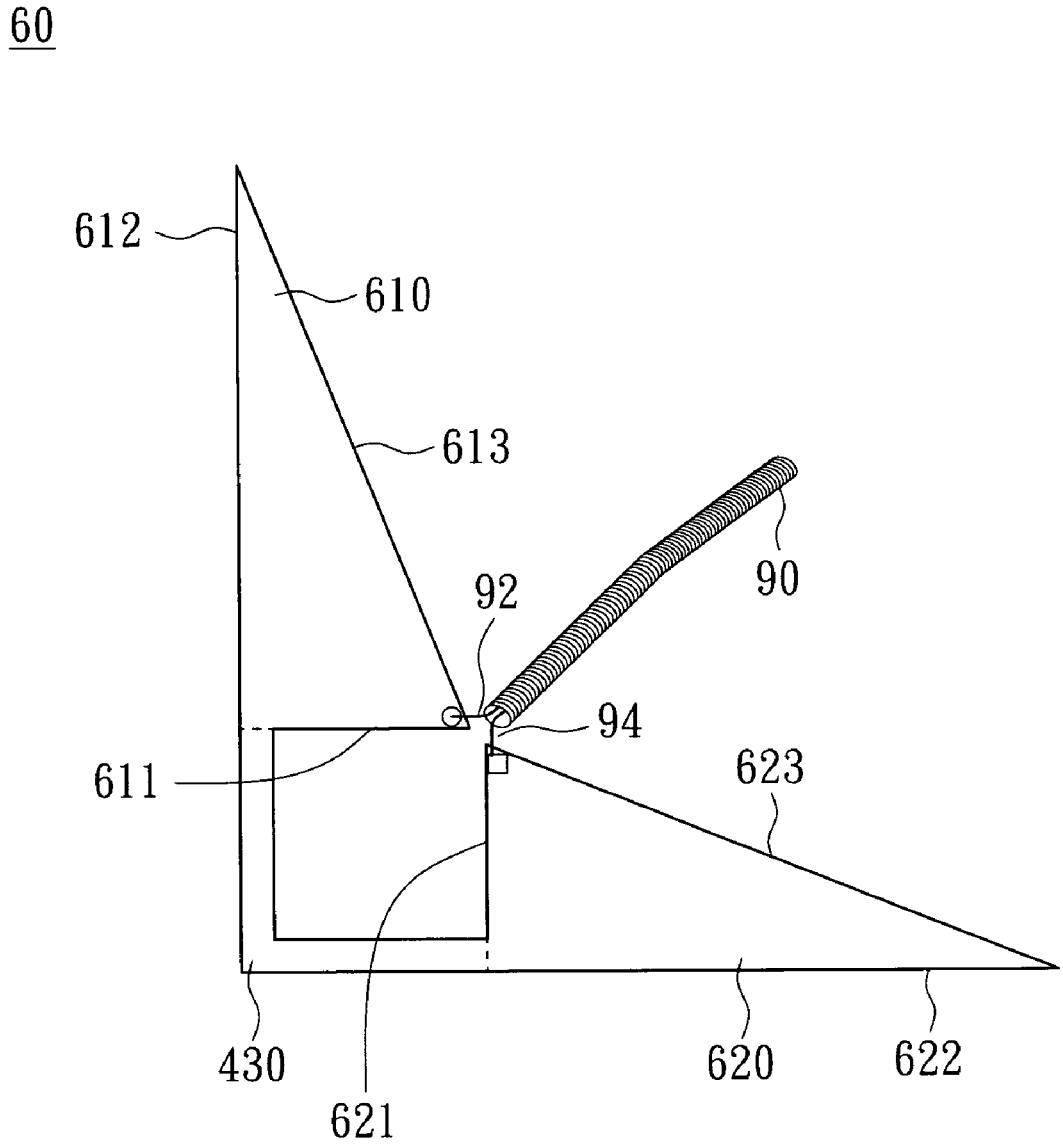
FIG. 7 is a schematic diagram of a short-circuited dipole antenna according to a third embodiment of the invention.

Referring to FIG. 7, a schematic diagram of a short-circuited dipole antenna according to a third embodiment of the invention is shown. The difference between the third embodiment and the first embodiment lies on that the radiation units 610 and 620 of the third embodiment have different shapes from the radiation units 410 and 420 of the first embodiment.

The radiation unit 610 includes sides 611, 612, and 613. For example, the side 613 is longer than the side 612, and the side 612 is longer than the side 611. The sides 611 and 612 are substantially vertical to each other, and the sides 611, 612 and 613 form a triangle.

Similarly, the radiation unit 620 includes sides 621, 622, and 623. For example, the side 623 is longer than the side 622, and the side 622 is longer than the side 621. The sides 621 and 622 are substantially vertical to each other, and the sides 621, 622 and 623 form another triangle.

Embodiment Four

Figure 8:
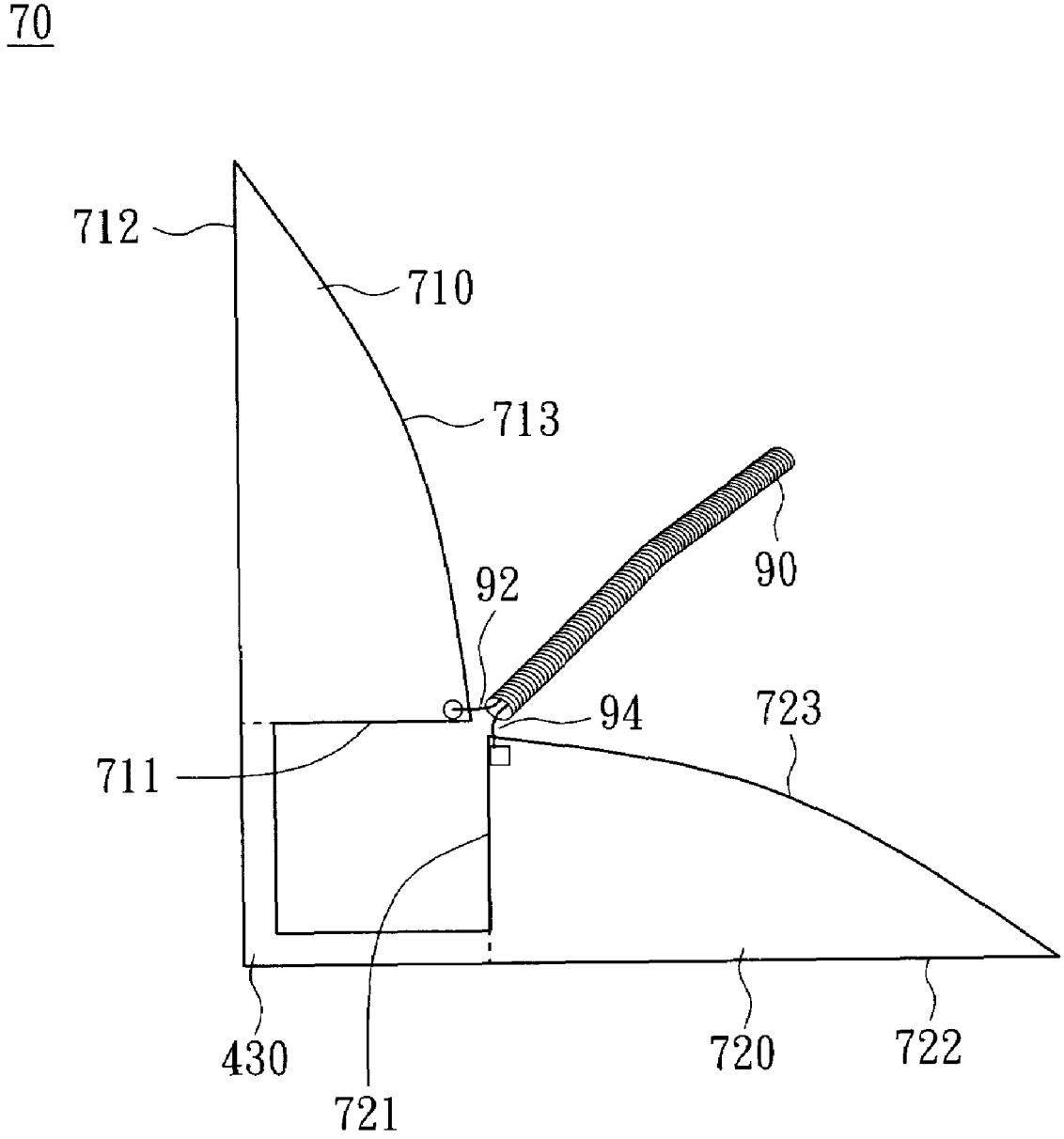
FIG. 8 is a schematic diagram of a short-circuited dipole antenna according to a fourth embodiment of the invention.

Referring to FIG. 8, a schematic diagram of a short-circuited dipole antenna according to a fourth embodiment of the invention is shown. The difference between the fourth embodiment and the first embodiment lies on that the radiation units 710 and 720 of the fourth embodiment have different shapes from the radiation units 410 and 420 of the first embodiment.

The radiation unit 710 includes sides 711, 712, and an arc side 713. For example, the side 712 is longer than the side 711. The sides 711 and 712 and the arc side 713 form a blade shape.

Similarly, the radiation unit 720 includes sides 721, 722, and an arc side 723. For example, the side 722 is longer than the side 721. The sides 721 and 722 and the arc side 723 form another blade shape.

The electronic device and short-circuited dipole antenna thereof disclosed by the above embodiments of the invention have the following advantages owing to that the short-circuited unit is connected between the first radiation unit and second radiation unit:

1. The structure of the short-circuited dipole antenna is simpler than the prior art;

2. The manufacturing of the short-circuited dipole antenna is easier than the prior art;

3. The manufacturing cost of the short-circuited dipole antenna is lower than the prior art;

4. The size of the radiation unit is smaller; and

5. The short-circuited dipole antenna can be disposed in a corner of the electronic device to prevent deteriorating the appearance of the electronic device.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A short-circuited dipole antenna, comprising:

a first radiation unit having a first side and a second side connected to each other, wherein the second side is longer than the first side;

a second radiation unit having a third side and a fourth side connected to each other, wherein the fourth side is longer than the third side; and a short-circuited unit, comprising:

a first terminal, connected to a part of the first side of the first radiation unit; and a second terminal, connected to a part of the third side of the second radiation unit;

wherein extension directions of the second side and the fourth side form an angle between 90 degrees and 180 degrees.

2. The short-circuited dipole antenna according to claim 1, wherein the first side and the second side are substantially vertical to each other, and the third side and the fourth side are substantially vertical to each other.

3. The short-circuited dipole antenna according to claim 2, wherein the minimum distance between the first radiation unit and the second radiation unit is between 0 and 2 mm.

4. The short-circuited dipole antenna according to claim 2, wherein the first radiation unit, the second radiation unit and the short-circuited unit are manufactured into a unity.

5. The short-circuited dipole antenna according to claim 2, wherein the first radiation unit, the second radiation unit and the short-circuited unit are formed on a dielectric substrate by printing.

6. The short-circuited dipole antenna according to claim 2, wherein the first radiation unit, the second radiation unit and the short-circuited unit are formed on a dielectric substrate by etching.

7. The short-circuited dipole antenna according to claim 2, wherein the first radiation unit, the second radiation unit and the short-circuited unit are formed by cutting metal sheets.

8. The short-circuited dipole antenna according to claim 2, wherein the first radiation unit further has a fifth side and a sixth side, the fifth side and the sixth side are substantially in parallel to the first side and the second side respectively, and the first side, the second side, the fifth side and the sixth side form a first rectangle, the second radiation unit further has a seventh side and an eighth side, the seventh side and the eighth side are substantially in parallel to the third side and the fourth side respectively, and the third side, the fourth side, the seventh side and the eighth side form a second rectangle.

9. The short-circuited dipole antenna according to claim 8, wherein the second side is longer than the first side and the fourth side is longer than the third side.

10. The short-circuited dipole antenna according to claim 2, wherein the first radiation unit further has a fifth side, a sixth side, a seventh side and an eighth side, the fifth side and the seventh side are substantially in parallel to the first side, the sixth side and the eighth side are substantially in parallel to the second side, the first side, the second side, the fifth side, the sixth side, the seven side and the eighth side form a first L shape, the second radiation unit further has a ninth side, a tenth side, an eleventh side and a twelfth side, the ninth side and the eleventh side are substantially in parallel to the third side, the tenth side and the twelfth side are substantially in parallel to the fourth side, and the third side, the fourth side, the ninth side, the tenth side, the eleventh side and the twelfth side form a second L shape.

11. The short-circuited dipole antenna according to claim 10, wherein the seventh side is longer than the first side and the eleventh side is longer than the third side.

12. The short-circuited dipole antenna according to claim 2, wherein the first radiation unit further has a fifth side, the first side, the second side and the fifth side form a first triangle and the second radiation unit further has a sixth side, the third side, the fourth side and the sixth side form a second triangle.

13. The short-circuited dipole antenna according to claim 12, wherein the fifth side is longer than the second side, the second side is longer than the first side, the sixth side is longer than the fourth side and the fourth side is longer than the third side.

14. The short-circuited dipole antenna according to claim 2, wherein the first radiation unit further has a first arc side, the first side, the second side and the first arc side form a first blade shape, and the second radiation unit further has a second arc side, the third side, the fourth side and the second arc side form a second blade shape.

15. The short-circuited dipole antenna according to claim 14, wherein the second side is longer than the first side and the fourth side is longer than the third side.

16. The short-circuited dipole antenna according to claim 1, wherein the first radiation unit and the second radiation unit respectively have a first feed point and a second feed point for connecting to a central conductor and an external grounding conductor of a coaxial transmission line.

17. The short-circuited dipole antenna according to claim 1, being disposed in an electronic device.

* * * * *